US006295666B1

(12) United States Patent
Takaura

(10) Patent No.: US 6,295,666 B1
(45) Date of Patent: Oct. 2, 2001

(54) METHOD OF CHANGING THE POSTURE OF A PATIENT ON A NURSING BED

(76) Inventor: Kiyoshi Takaura, 30-3, 1-chome, Shin-sakasai, Kashiwa-Shi, Chiba (JP)

( * ) Notice: Subject to any disclaimer, the term of this patent is extended or adjusted under 35 U.S.C. 154(b) by 0 days.

(21) Appl. No.: 09/427,091

(22) Filed: Oct. 26, 1999

(30) Foreign Application Priority Data

Nov. 6, 1998 (JP) ..... 10-352032

(51) Int. Cl.[7] ..... A61G 7/10; A61G 7/015
(52) U.S. Cl. ..... 5/88.1; 5/611; 5/612; 5/617
(58) Field of Search ..... 5/88.1, 81.1 R, 5/83.1, 81.1 T, 611, 612, 617

(56) References Cited

U.S. PATENT DOCUMENTS 4,502,169 * 3/1985 Persson ..... 5/88.1
4,843,665 * 7/1989 Cockel et al. ..... 5/88.1
5,161,267 * 11/1992 Smith ..... 5/88.1

FOREIGN PATENT DOCUMENTS

2410414 * 9/1975 (DE) ..... 5/88.1
7-313557 * 7/1995 (JP) ..... 5/617

* cited by examiner

*Primary Examiner*—Alexander Grosz
(74) *Attorney, Agent, or Firm*—Wenderoth, Lind & Ponack, L.L.P.

(57) ABSTRACT

The posture of a patient on a nursing bed can be changed by separating a bed tray that is in a base of the nursing bed from leg-side lifts and hand-side lifts. Leg-side and head-side nets are fully stretched, and the body of the patient is supported on the leg-side net and the head-side net above the bed plate using the leg-side lifts and head-side lifts while the patient faces upwards. An elongate cushion is then placed lengthwise on the bed plate. The body of the patient is then lowered until the body comes into contact with the elongate cushion. Winding drums are then rotated to pull on the nets on the side toward which it is decide to turn the patient so as to loosen the leg-side and head-side nets, so that the body of the patient rolls on the elongate cushion toward that side, and so that the body of the patient is supported by the bed plate. The elongate cushion is then subsequently removed from the bed plate.

3 Claims, 11 Drawing Sheets

METHOD OF CHANGING THE POSTURE OF A PATIENT ON A NURSING BED

BACKGROUND OF THE INVENTION

1. Field of the Invention

The present invention relates to a nursing bed capable of allowing a nurse or attendant to change the bedding such as a mat or futon for a patient, to raise the back of the body of the patient and to change the lying posture of the patient on the bed plate, and also capable of adjusting the height thereof, the height of the lower and upper portions of the patient's body, lifting the patient in a hammock fashion and allowing the patient to use a chair on the bed plate.

2. Description of the Related Art

As prior art technology, there exists an invention entitled "A Medical Treatment Bed" disclosed in Japanese Patent Application No. 140650/1994 which was filed by the present applicant on May 20, 1994. According to paragraph 1 of the scope of claim for patent column of the specification attached to the application, there is a description reading "A medical treatment bed comprising a base (1), two movable portions (3) respectively arranged at leg-side and head-side ends of the base (1) and capable of being adjusted of their heights by means of cylinders (2) or motors, an independent bed plate (6) placed on the central portion of the base (1) so as to allow bedding (4) such as a mat or futon to be placed thereon and provided with fixing holes (5) at both sides of the leg-side end and the head-side end of the base (1), a pair of leg-side arms (7) separated from each other by a distance longer than the width of the bed plate (6) and projecting toward the head-side end of the bed plate (6) from the leg-side movable portions (3), respectively, a flexible and gas-permeable mesh-like or cloth-like lower leg support member (8) removably stretched over the whole of the pair of leg-side arms (7) or over a desired region excluding the waist portion of a patient, a pair of head-side arms (9) separated from each other by a distance longer than the width of the bed plate (6) and projecting toward the leg-side end of the bed plate (6) from the head-side movable portions (3), respectively, a pair of backrest arms (1) respectively arranged at the head-side arms (9) and capable of being adjusted of their angles by cylinders (2) or motors, a flexible and gas-permeable mesh-like or cloth-like upper body support member (11) removably stretched over the whole of the pair of the backrest arms (10) or over a desired region excluding the waist portion of the patient, and fixing means (12) such as knockpins respectively arranged at the leg-side arms (7) and at the head-side arms (9) and capable of fixing and releasing the bed (6) through the fixing holes (5) and characterized in that when the bed (6) is fixed between the pair of leg-side arms (7) and between the pair of headside arms (9) by means of the fixing means (12), the lower leg support member (8) and the upper body support member (11) cover the upper surface of the bedding (4)."

However, the above-described "medical treatment bed" has had the following five problems.

(1) When a patient is lifted in a hammock fashion, since a space which is wide enough to receive the waist of the patient is provided between the "lower leg support member" and the "upper body support member", the waist of the patient sometimes slips down from the space so that the patient not only has to assume a disagreeable posture, but there is also a fear of his falling down onto the bed plate. Because of such structure, it is not possible to keep him under a hammocked condition.

(2) When the back of the patient is raised, since the angle of the "backrest arms" is adjusted about a fixed shaft, when the angle of inclination of the "upper body support member" becomes large, the upper portion of the patient's body (especially the back and waist of the body) is strongly pushed forward so that the whole of the patient's body slips forward. On the contrary, where the back of the patient's body is lowered by reducing the angle of the "backrest arms", the "upper body support member" moves away from the patient's body while leaving the body at the moved position so that the patient comes to lie on his back on the bed plate. Therefore, if the patient can not move himself because of his health condition, he will not be able to return to his original lying position, so that his attendant will have to move his body toward the head-side end of the bed plate.

(3) Even when it is desired to shift the backrest position of the patient forward or rearward depending on his physical form or his health condition, since the positional relationships among the "head-side arms", the "backrest arms" and the "upper body support member" are not flexible, it is not possible to adjust the position at which the back of the patient's body is raised.

(4) Even when the extended conditions of the "lower-leg support member" and the "upper body support member" are desired to be changed when lifting the patient's body in a hammock fashion or the back of the patient is raised, since the "lower-leg support member" and the "upper body support member" are directly and removably fixed to the "leg-side arms" and the "patient's back raising arms", respectively, it is not possible to strongly stretch or loosen the members. When extension conditions of both of the members are changed, there is no other choice than adjusting the length of each of them in advance when fixing them.

(5) Where the position of the body of the patient is changed from its usual supine position to its recumbent position, quite the same operation as the usual operation is required, so that his attendant must make a great effort to do so, at the risk of damaging his own body.

SUMMARY OF THE INVENTION

Accordingly, an object of the present invention is to provide a nursing bed which solves all the problems involved in the conventional nursing bed.

Another object of the present invention is to provide a turnover posture changing method using the above-described nursing bed.

According to one aspect of the present invention, there is provided a nursing bed which comprises a bed plate provided with connecting sections arranged on both sides of a leg-side portion and on both sides of a head-side portion thereof A rectangular base having a height a little higher than floor level allows the bed plate to be placed on the central portion thereof with the length of the base being larger than that of the bed plate. A pair of leg-side lifts are respectively arranged on both sides of a leg-side end of the base and capable of being adjusted in height. A pair of head-side lifts are respectively arranged on both sides of a head-side end of the base so as to be operated independently of, and in interlocking relationship with, the leg-side lifts, and are capable of being adjusted in height. A total of four connecting means are arranged at movable portions of the leg-side lifts and the head-side lifts, respectively, and are capable of being connected to, and separated from, connecting sections of the bed plate at the lowermost positions of the leg-side and head-side lifts such that when the connecting means are connected to the connecting sections of the bed plate, the height of the bed plate can be adjusted by vertically moving the bed plate, while when the connecting means are separated from the connecting sections of the bed plate, the bed plate is placed on the base. A pair of hollow leg-side arms, whose inner surfaces serve as rail guides, respectively, extend parallel and horizontally toward the head-side portion of the bed plate up to a position substantially one-third of the length of the bed plate, leaving therebetween a space larger than the width of the bed plate. They are capable of moving vertically in interlocking relationship with the leg-side lifts. A pair of leg-side rails are respectively retained within the pair of leg-side arms and are capable of sliding toward the head-side portion of the bed plate in interlocking relationship with each other. A pair of leg-side fixing arms are formed to lie parallel to the outer sides of the leg-side arms by turning up from the head-side top ends of the leg-side rails toward the leg-side portion of the bed plate and are capable of sliding in interlocking relationship with the leg-side rails. A pair of leg-side net winding devices are respectively attached to the pair of leg-side fixing arms and provided with a pair of leg-side net winding drums capable of being operated independently of each other.

A leg-side net sheet has a width larger than the distance between the pair of leg-side net winding drums and has both sides thereof removably fixed to the leg-side net winding drums, respectively, so that when the leg-side net winding drums are rotated outward, the leg-side net is stretched to the full, while when the winding drums are rotated inward, the leg-side net is loosened. The intermediate portion of the net may be arranged between the bed plate and the lower portion of the body of a patient so as to cover the upper surface of the bed plate and so as to lift that portion of the patient.

A pair of hollow head-side arms have inner surfaces serving as rail guides, respectively, and extend parallel and horizontally toward the leg-side portion of the bed plate up to a position substantially one-third of the length of the bed plate, leaving therebetween a space larger than the width of the bed plate. They are capable of moving vertically in interlocking relationship with the head-side lifts. A pair of head-side rails are respectively retained within the pair of head-side arms and capable of sliding toward the leg-side portion of the bed plate in interlocking relationship with each other. A pair of head-side fixing arms each have one end thereof rotatably supported by a shaft at each of the leg-side portions of the pair of head-side rails and are provided at portions below the shaft with a circular arc-shaped cam groove which extends further from the shaft toward the head-side end of the bed plate than toward the leg-side end of the bed plate so that the head-side fixing arms can upwardly rotate about the shaft in interlocking relationship with each other by an angle of substantially 90° from their horizontal folded positions parallel to the outer sides of the head-side arms. A pair of cam roller fixing bars have their head-side portions fixed to the head-side arms, respectively, while the top ends of their leg-side portions are respectively provided with cam rollers which are mounted in their respective cam grooves such that the larger the angle of between the head-side rails and the head-side fixing arms, the shorter the distance between the cam rollers and the shaft due to the rotation of the cam grooves, thereby causing the head-side rails to automatically slide toward the head-side end of the bed plate by the shortened distance. A pair of head-side net winding means are respectively attached to the pair of head-side fixing arms and provided with a pair of head-side net winding drums capable of being operated independently of each other. A head-side net sheet having a width larger than the distance between the pair of head-side net winding drums has both sides thereof removably fixed to the head-side net winding drums, respectively, so that when the head-side net winding drums are rotated outward, the head-side net is stretched to the fill, while when the winding drums are rotated inward, the head-side net is loosened. The intermediate portion of the net can be arranged between the bed plate and the lower portion of the body of a patient so as to cover the upper surface of the bed plate and so as to lift that portion of the patient's body or to raise the back of that portion of the patient's body.

In the above-described aspect of the invention, the positions at which the head-side portions of the pair of cam roller fixing bars are respectively fixed to the pair of head-side arms can be adjusted forward and rearward, whereby the position at which the back of the upper portion of the patient's body is raised by the head-side net is made adjustable forward and rearward.

According to another aspect of the present invention, there is provided a turnover posture changing method making use of the above-described nursing bed, which method comprises the steps of placing the bed plate on the base, separating the bed plate from the leg-side lifts and the head-side lifts, stretching the leg-side net and the head-side net fully to the right and left, lifting the body of a patient supported by the leg-side net and the head-side net above the bed plate with the patient facing upward, placing an elongate pillow-like cushion lengthwise on the bed plate, lowering the body of the patient supported by the leg-side net and the head-side net until the body of the patient comes into contact with the elongate pillow-like cushion, rotating inward only the leg-side net winding drum and the head-side winding drum lying on the side toward which the patient's body is, desired to be turned over while loosening the sides of the leg-side net and the headside net toward which the patient's body is desired to be turned over, whereby the patient's body slowly rolls down sideward from on the elongate pillow-like cushion and reaches the surface of the bed plate with the patient's posture facing sideward, and removing the elongate pillow-like cushion from the bed plate.

The adjustment of the height of the nursing bed may be performed so that the leg-side lifts and the head-side lifts are connected to the bed plate by means of the four connecting means (referring to FIGS. 4(A) and 4(B)). The bed plate is moved vertically by interlocking the leg-side end with the head-side end of the bed plate (refer to FIG. 6, FIGS. 10(A), 10(B) and 10(C)).

The upper portion of the back of the patient's body is raised upward while the head-side net is slid toward the head-side end of the bed plate, because the larger the angle of each of the head-side fixing arms with respect to each of the head-side rails, the shorter the distance between the position of each of the shafts respectively fixed to the head-side rails, allowing the head-side rails to automatically slide toward the head-side end of the bed plate in correspondence to the degree of shortening of the distance, so that the patient's body is never pushed forward at the time of raising the back of the patient's body (refer to FIG. 1(A) and FIG. 2). On the contrary, the smaller the angle of each of the head-side fixing arms with respect to each of the head-side rails, the longer the distance between the position of each of the cam grooves respectively fixed to the head-side rails and each of the shafts respectively fixed to the head-side rails, allowing the headside rails to automatically slide toward the leg-side end of the bed plate in correspondence to the degree of enlargement of the distance, so that the back of the patient's body is lowered while the head-side net is slid toward the head-side end of the bed plate. The patient's body is never separated from the head-side net when lowering the back of the patient's body.

In order to lift the patient's body above the bed plate in a hammock fashion, the leg-side lifts and the head-side lifts disconnected from the bed plate are manipulated so that the lower portion of the patient's body can be supported by the leg-side net and the upper portion of the patient's body can be raised by the head-side net (refer to FIGS.7 and 8). Further, it is also possible to adjust the height of the leg-side net and that of the head-side net separately from each other in a hammock fashion. The distance between the leg-side net and the head-side net is adjusted depending on the physical constitution of the patient, his physical power and his health condition.

The distance between the leg-side net and the head-side net can be adjusted by movement of the leg-side net, which slides in interlocking relationship with the leg-side rails, so that by reducing the distance, the patient's waist can be securely supported by the leg-side net (refer to FIG.7). By enlarging the distance, the space around the patient is waist is made free (refer to FIG.8).

In order for the patient to sit down on a chair or a closet on the bed plate, the leg-side net and the head-side net are held fully stretched by adjusting the distance between the two nets, the bed plate is placed on the base, the connecting devices are separated (refer to FIGS. 1(A) and 1(B)), the patient's body is supported in a hammock fashion above the bed plate (refer to FIGS.7 and 8), the chair or closet is set up on the bed plate and the leg-side net and the head-side net are lowered until the patient's waist is placed on the chair or closet. Where the distance between the leg-side net and the head-side net is so narrow as to allow both of the nets to hang over the chair or closet, the leg-side net is slid toward the head-side net to thereby wide the distance. The back of the patient's body is then raised by the head-side net while the leg-side net is lowered to the surface of the bed plate, thereby causing the patient to assume a sitting posture (refer to FIG. 9). Further, when the above-described steps are reversed, it is possible for the bed plate to return to its usual condition. The distance between the leg-side net and the head-side net is adjusted depending on the physical constitution, physical power and health condition of the patient.

Further, in order to freely adjust the extension of the leg-side net or the head-side net when hammocking the patient or raising the back of the patient's body, the leg-side winding drums or the head-side winding drums may be rotated outward to stretch the net (refer to FIG. 14 (A)) or may be rotated inward to loosen the net (refer to FIG. 14(B)).

As regards the forward and rearward backrest positions of the patient's body, the position at which the back of the upper portion of the patient's body is raised can be adjusted forward and rearward by changing the positions at which the right and left cam roller fixing bars are respectively fixed to the head-side arms forward (refer to FIG.1A) and FIG.2) and rearward (refer to FIGS. 11(A) and 11(3B)). The above-described forward and rearward backrest positions may be adjusted depending on the physical constitution, physical power and health condition of the patient.

To change the posture of the patient to the right or left, the distance between the leg-side net and the head-side net is adjusted to stretch both of the nets to the full (refer to FIG. 12A). The patient's body is then lifted above the bed plate in a hammock fashion (refer to FIGS. 7, 8 and 12 (B)), the elongate pillow-like cushion is set lengthwise on the bed plate (refer to FIG. 12(B)), the patient's body is lowered until it reaches the elongate pillow-like cushion (refer to FIG. 12(C)), and only the leg-side net winding drum and the head-side net winding drum on the side toward which the patient's body is desired to be turned over are rotated inward to thereby loosen the leg-side net and the head-side net on that side, allowing the patient's body to lie sideways on the bed plate (refer to FIG. 12(D)). Lastly, the elongate pillow-like cushion is removed from the bed plate.

Even when the back of the patient is raised, the patient's clothes are changed, a chair or closet is used or the turnover posture of the patient is changed, the sheet and the like are never disordered, because the leg-side net and the head-side net cover the surface of the bed plate or supports the patient in a hammock fashion.

PREFERRED EMBODIMENT OF THE INVENTION

Figure 1A:
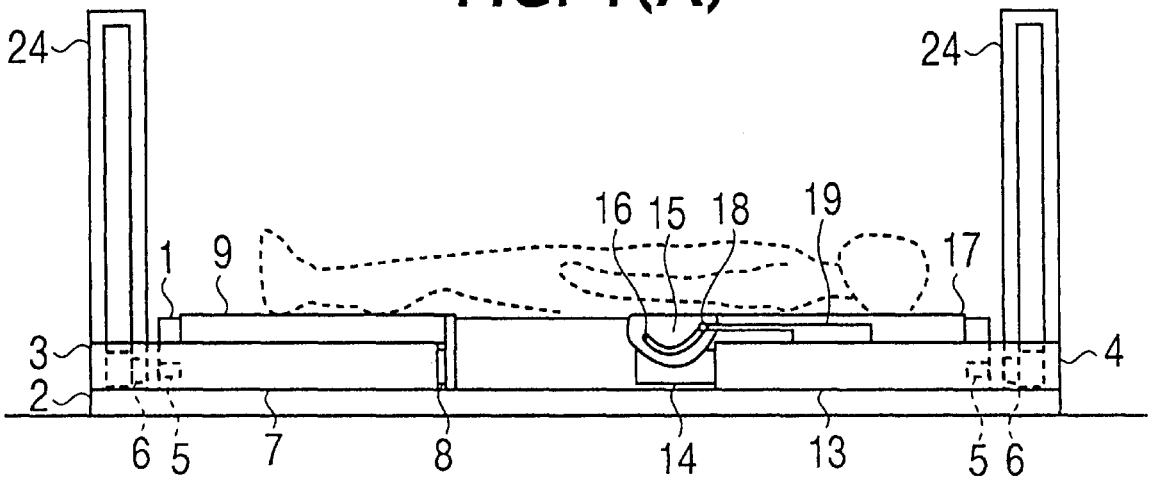
FIG. 1(A) is a side view of one aspect of a nursing bed according to an embodiment of the present invention.
Figure 1B:
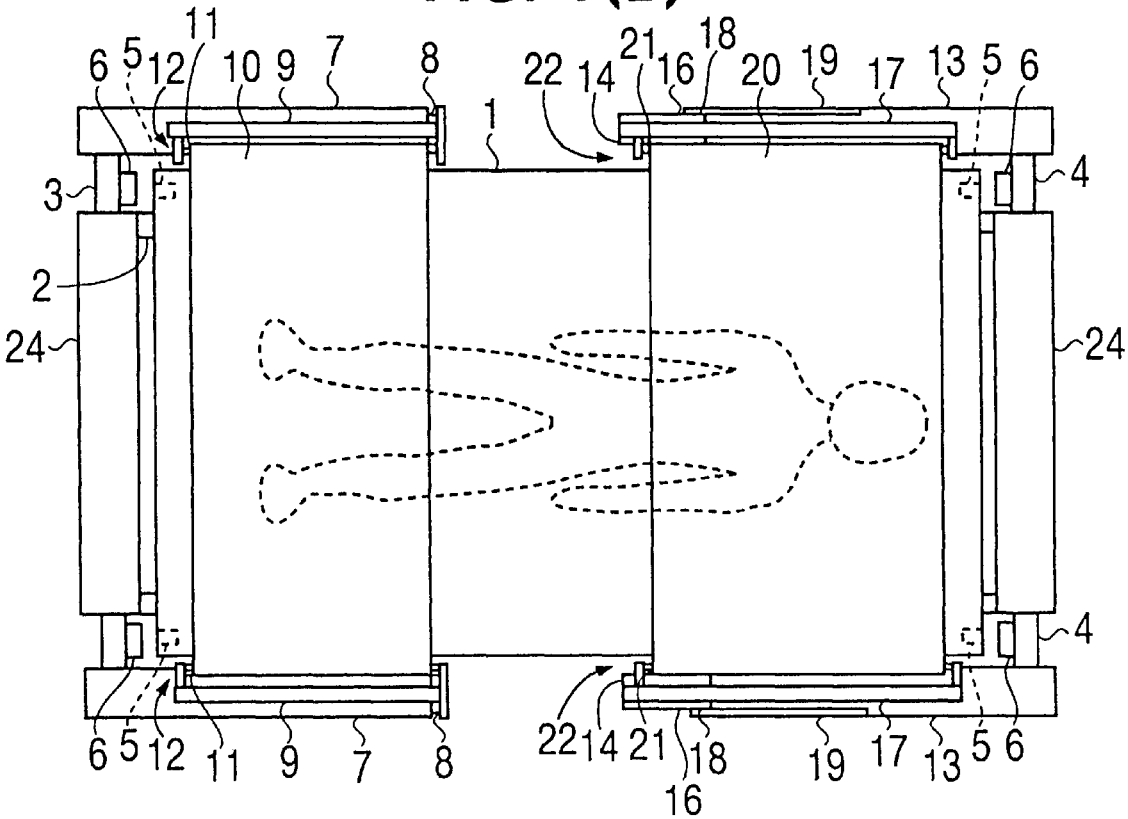
FIG. 1(B) is a plan view of the nursing bed shown in FIG.1(A)
Figure 2:
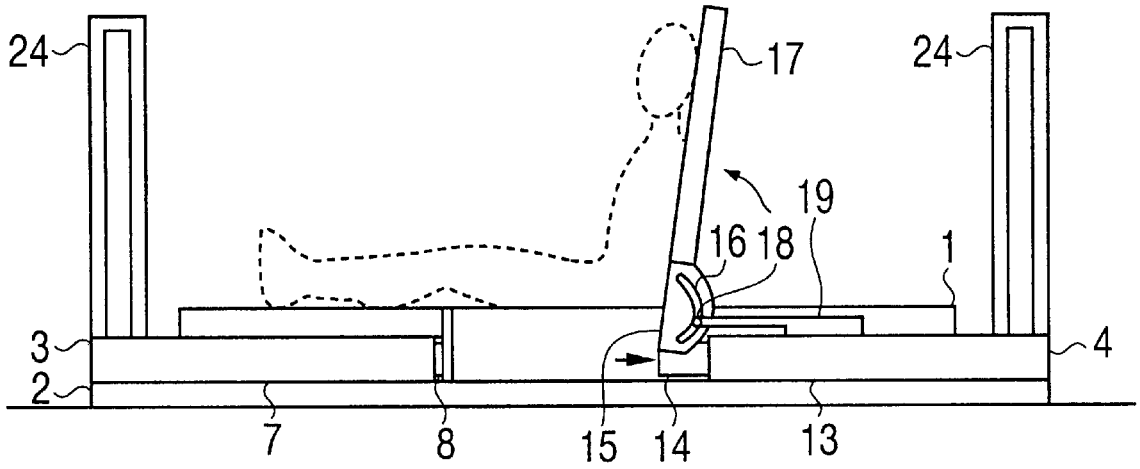
FIG. 2 is a side view of the nursing bed of the present invention when the back of the body of a patient lying on the bed plate is raised.

The preferred embodiment of the present invention will now be described with reference to accompanying drawings but it should be noted that the invention is not always limited to this embodiment, and various modifications may be made within the scope and spirit of the invention.

The nursing bed according to the present invention comprises a bed plate 1, a base 2, a pair of leg-side lifts 3, a pair of leg-side hollow arms 7, a pair of leg-side rails 8, a pair of leg-side fixing arms 9, a pair of leg-side net winding means 12, a leg-side net 10, a pair of head-side lifts 4, a pair of head-side arms 13, a pair of head-side rails 14, a shaft 15, a pair of head-side fixing arms 17, a pair of cam rollers 18, a pair of cam roller fixing bars 19, a pair of head-side net winders 22 and a head-side net 20.

The base 2 is of a rectangular frame structure arranged a little higher than the floor level and the bed plate 1 is an independent structure capable of being placed on the central portion of the base 2. At the four corners of the bed plate 1 there are provided four connecting portions 5, respectively, and the longitudinal side of the base 2 is longer than that of the bed plate 1. The leg-side lifts 3 are respectively provided at the leg-side ends of the base 2 in such a manner that the height of each of them is adjustable. The head-side lifts 4 are respectively provided at both sides of the head-side end of the base 2. The driving means for the lifts 3 and 4 are not specified, but in the instant embodiment, there are provided two lifting motors within head-side and leg-side lift covers 24, respectively.

Designated by reference numeral 6 are connections provided at movable portions of the leg-side lifts 3 and at movable portions of the head-side lifts 4, respectively, and capable of being connected to the connecting portions 5 of the bed plate 1. In the instant embodiment, the connecting portions 5 are respectively fixed to the connectors 6 by connecting pins, but other connecting means may be used.

The leg-side hollow arms 7, whose inner surfaces form respective rail guides, are arranged parallel to each other by projecting horizontally from the movable portions of the leg-side lifts 3 up to a position substantially one-third of the way along the bed 1 while keeping a distance larger than the width of the bed 1 between them. The arms 7 are movable vertically in interlocking relationship with the leg-side lifts 3, respectively. The leg-side rails 8 are slidably retained within the leg-side arms 7, respectively, and are capable of sliding toward the head-side end of the bed plate 1 in interlocking relationship with each other. Further, the leg-side fixing arms 9 extend from the head-side top ends of the leg-side rails 8 toward the leg-side of the bed plate 1 so as to run parallel to the leg-side arms 7, respectively, and are capable of sliding in interlocking relationship with the leg-side rails 8. The driving means for sliding the leg-side mounting arms 9 is not specified, but in the instant embodiment, the motors arranged in the leg-side lift covers 24, respectively, are used.

Figure 14A:
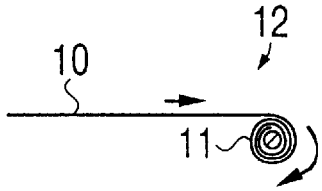
FIGS. 14(A) and 14(B) show one leg-side net winder, and especially how a leg-side net and a leg-side net winding drum operate.
Figure 14B:
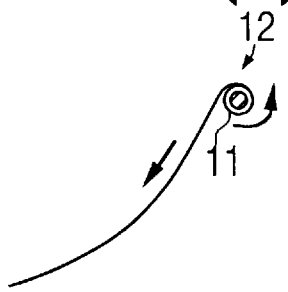

The leg-side net winders 12, which are respectively fixed to the leg-side mounting arms 9 are provided with leg-side net winding drums 11, respectively. The leg-side net 10 has a width larger than the space between the right and left leg-side net winding drums 11. Further, when the drums 11 are rotated outward, the leg-side net 10 is wound about the drums while when they are rotated inward, it is unwound. The leg-side winders 12 can be operated independently of each other. The driving means for winding or unwinding the leg-side net 10 is not specified. In FIGS. 12 (A) through 12(D) and FIGS. 14(A) and 14(B) there are shown sectional views of the leg side net winders 12.

Figure 3A:
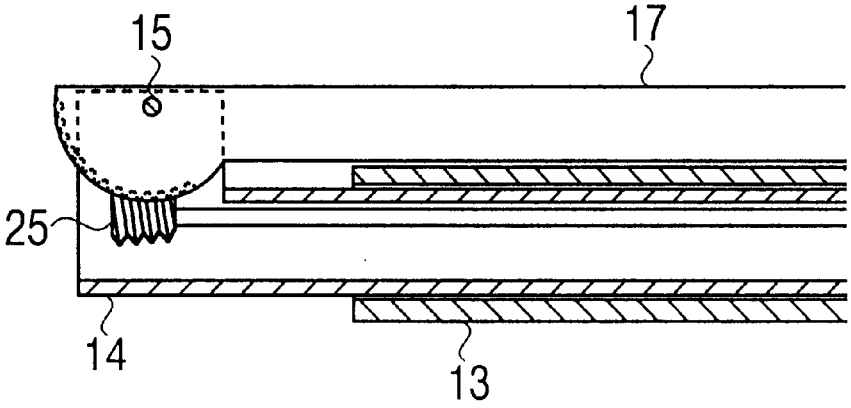
FIG. 3(A) is a sectional view of internal structure of a back-raising portion of the nursing bed in one position, with the exclusion of cam grooves, cam rollers and cam roller fixing bars.
Figure 3B:
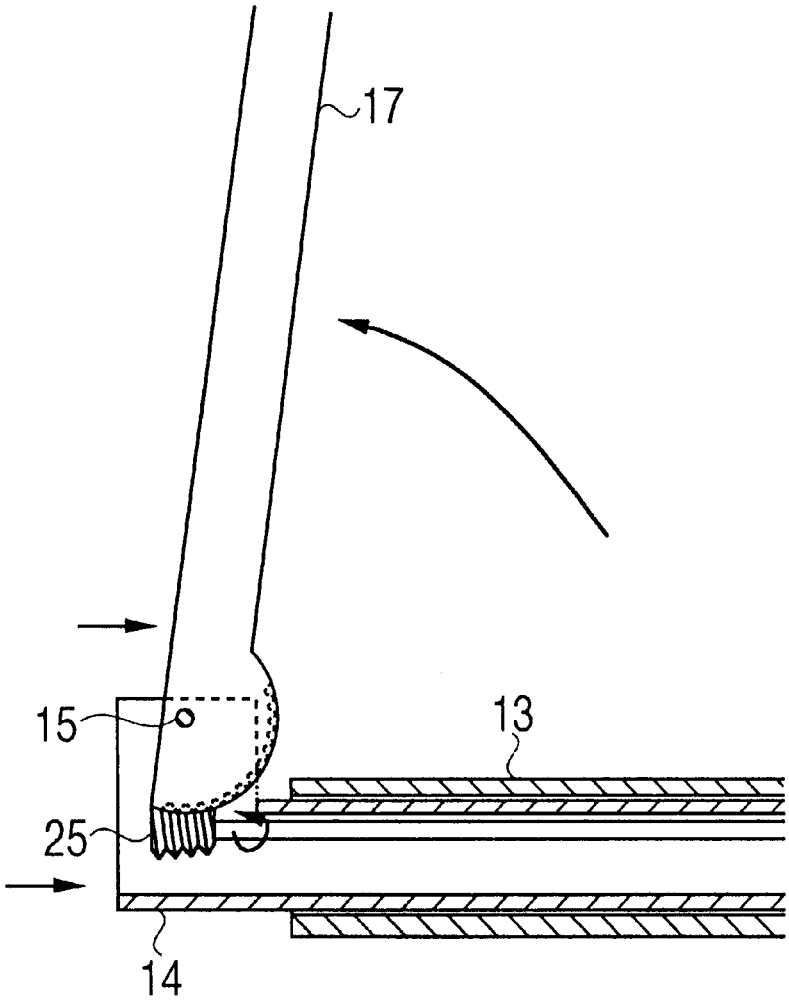
FIG. 3(B) is a sectional view of the same in another position, with the exclusion of the cam grooves, cam rollers and cam roller fixing bars.
Figure 4A:
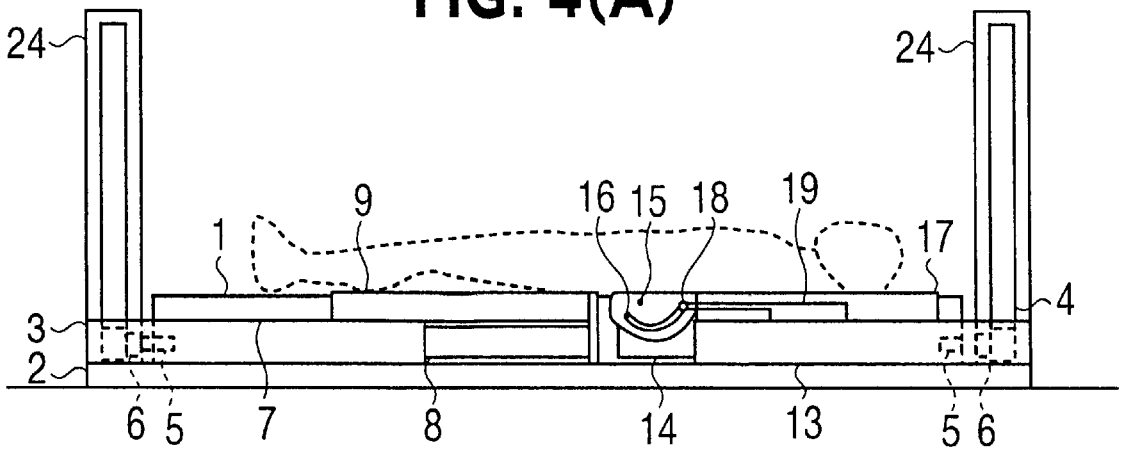
FIG. 4(A) is a side view of the nursing bed according to the embodiment of the present invention.
Figure 4B:
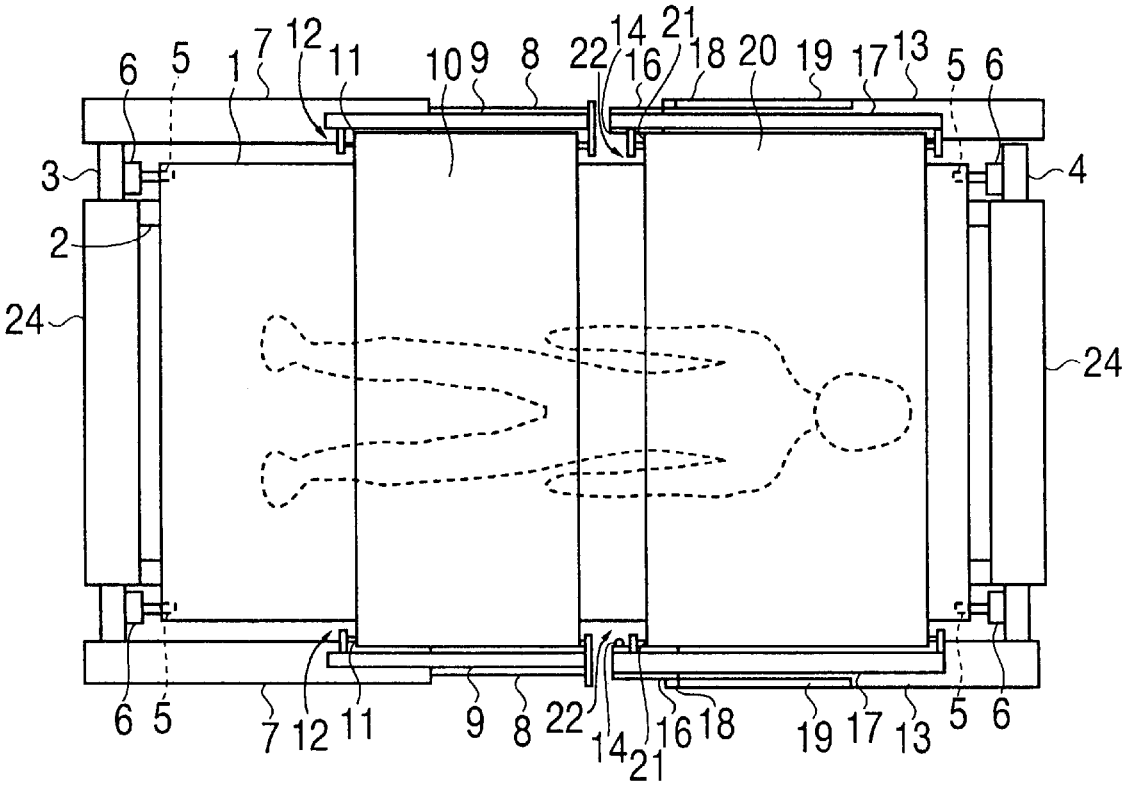
FIG. 4(B) is a plan view of the same.
Figure 5A:
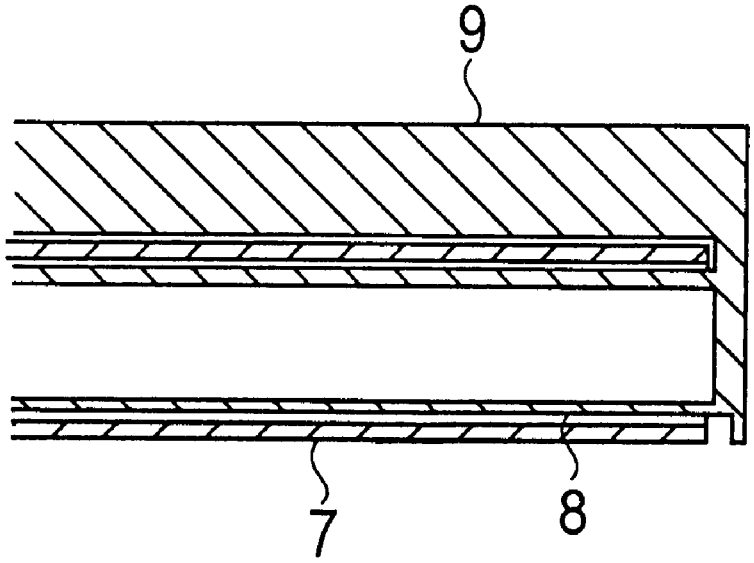
FIG. 5(A) is a sectional view showing one sliding condition of a leg-side mounting arm with respect to a leg-side rail.
Figure 5B:
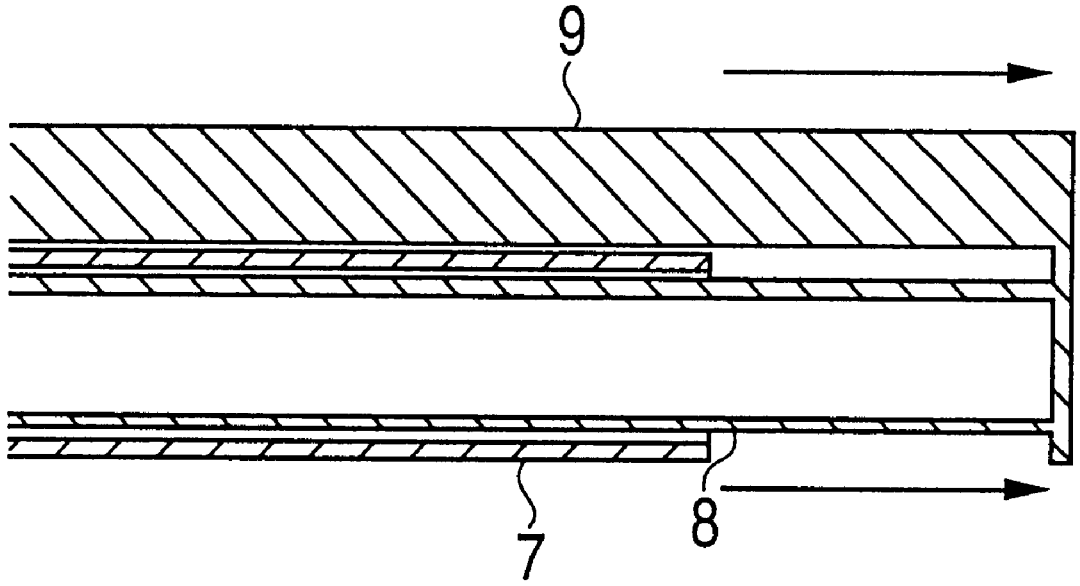
FIG. 5(B) is a sectional view showing another sliding condition of the leg-side mounting arm with respect to the leg-side rail.
Figure 6:
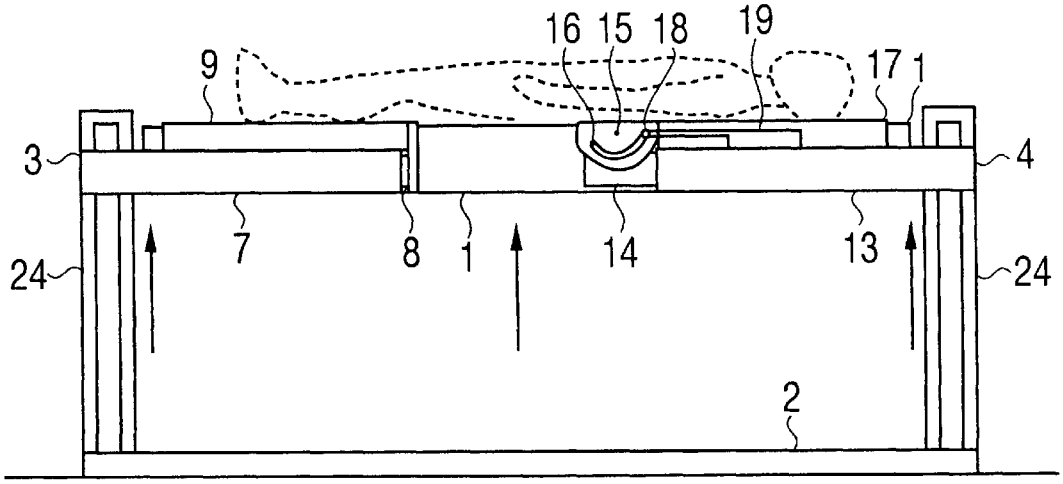
FIG. 6 is a side view of the nursing bed of the embodiment of the present invention showing how the nursing bed is moved vertically.

The head-side arms 13 have hollow inner surfaces serving as rail guides and project horizontally from the movable portions of the head-side lifts 4 toward the leg-side end of the bed plate 1 up to a position substantially one-third of the length of the bed plate 1 in parallel relationship with each other, leaving therebetween a space wider than the width of the bed plate 1. They are movable vertically in interlocking relationship with the head-side lifts 4. Further, the head-side rails 14 are retained within the head-side arms 13 so as to be slidable toward the legside end of the bed plate 1 in interlocking relationship with each other. The head-side fixing arms 17 are rotatably supported by the shaft 15 at one side thereof. Each of the head-side fixing arms 17 is provided at a portion thereof below the shaft 15 with a circular arc-shaped cam groove 16 which extends further from the shaft 15 toward the head-side end of the bed plate 1 than toward the leg-side of the bed plate 1 so that the arms 17 can rotate about the shaft 15 upward in interlocking relationship with each other to an angle of substantially 90° from their horizontal folded positions parallel to the outer sides of the head-side arms 13, respectively. The cam roller fixing bars 19 have head-side portions fixed to the head-side arms 13, respectively, while the ends of leg-side portions thereof are respectively provided with cam rollers 18 which are mounted in respective cam grooves 16. With such a structure, when the angle of inclination of each of the head-side fixing arms 17 is made large, each of the cam grooves 16 rotates about the shaft 15 and each of the cam rollers 18 traces each cam groove 16 so that the distance between the cam groove 16 and the shaft 15 becomes gradually shorter and the resultant distance difference is absorbed by the sliding of the head-side rails 14 toward the head-side. The power source for adjusting the angle of inclination of the head-side fixing arms 17 is not specified, but in the instant embodiment, rotating worm gears 25, shown in FIGS.3(A) and 3(B), are connected with a back-raising motor provided within the head-side lift cover 24 is used. Further, the nursing bed according to the instant embodiment has a structure such that the position at which the pair of cam roller fixing bars 19 are respectively fixed to the pair of head-side arms 13 can be shifted forward or rearward.

The pair of head-side net winders 22 are attached to the head-side mounting arms 17 and are provided with head-side net winding drums 21, respectively. The head-side net 20 has its both side ends removably attached to the head-side net winding drums 21, respectively, and the width of the net 20 is larger than the distance between the head-side net winding drums 21. Further, when the head-side net winding drums 21 are rotated outward, the head-side net 20 is wound around the drums while when they are rotated inward, the net 20 is unwound. The head-side winders, 22 can be operated independently of each other and means for driving the means 22 is not specified. The sectional configuration of each of the head-side winders 22 is basically the same as that of each of the leg-side net winders 12 shown in FIGS. 12 and 14.

Figure 7:
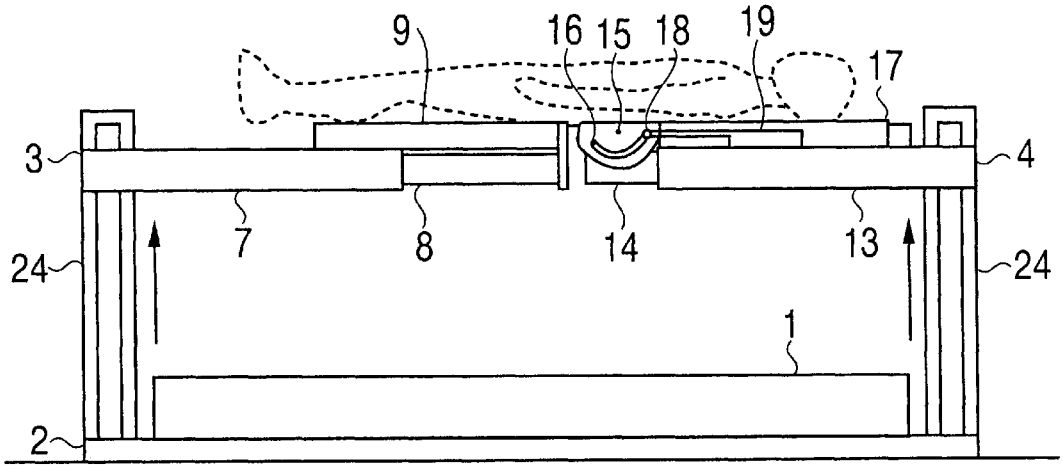
FIG. 7 is a side view of the nursing bed of the present invention showing how the body of the patient is lifted above the bed plate in a hammock fashion.
Figure 8:
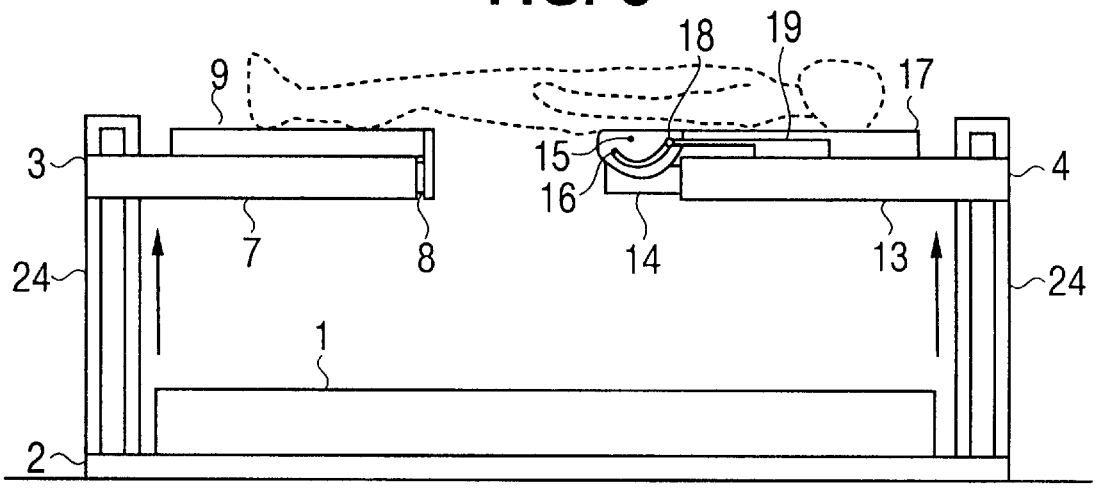
FIG. 8 is a side view of the nursing bed of the present invention showing how the body of the patient is lifted above the bed plate in a hammock fashion.
Figure 9:
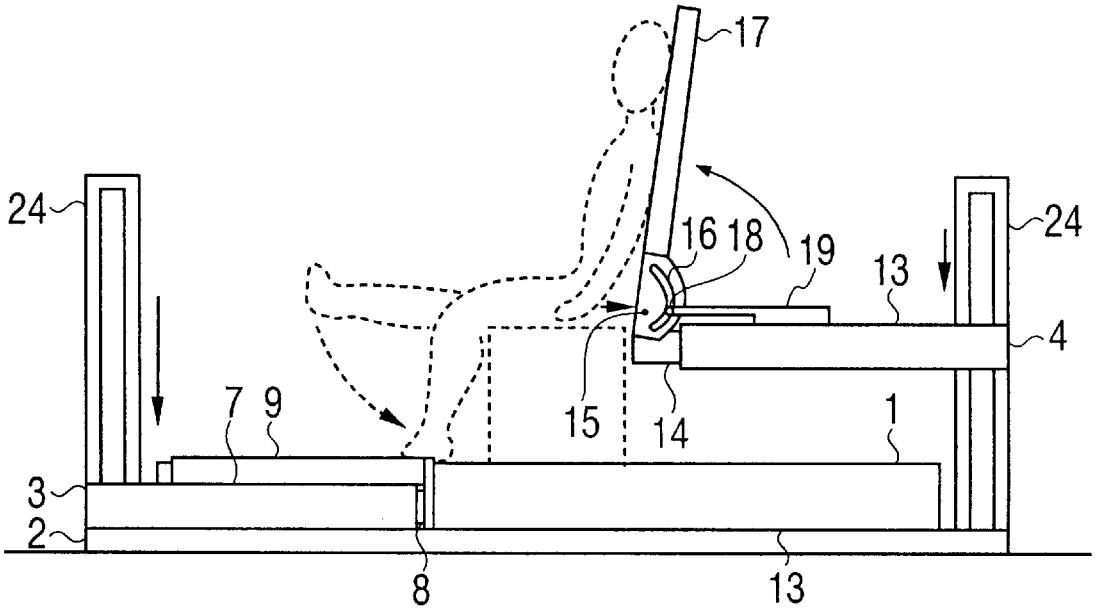
FIG. 9 is a side view of the nursing bed of the present invention showing how the patient uses a chair or closet on the bed plate.
Figure 10A:
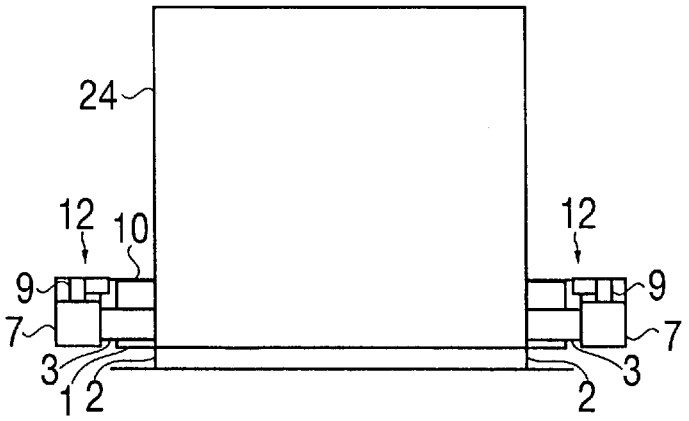
FIGS. 10(A) through 10(C) are front views of the nursing bed of the present invention as viewed from the leg-side of the bed plate, showing how the height of the bed plate is adjusted.
Figure 10B:
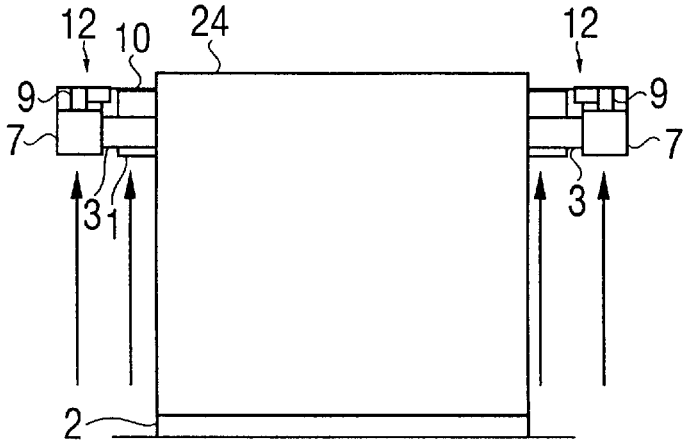
Figure 10C:
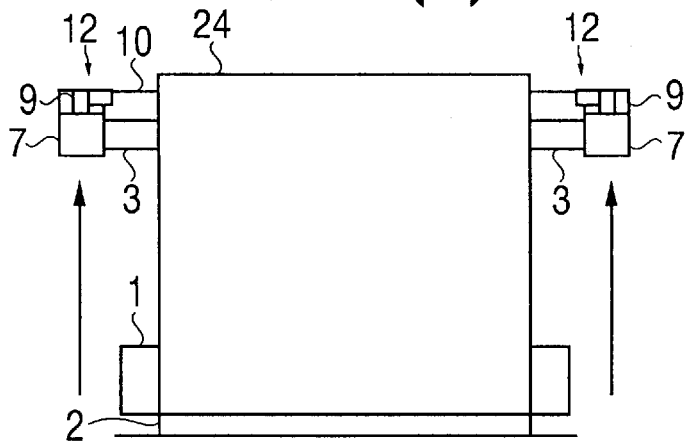
Figure 11A:
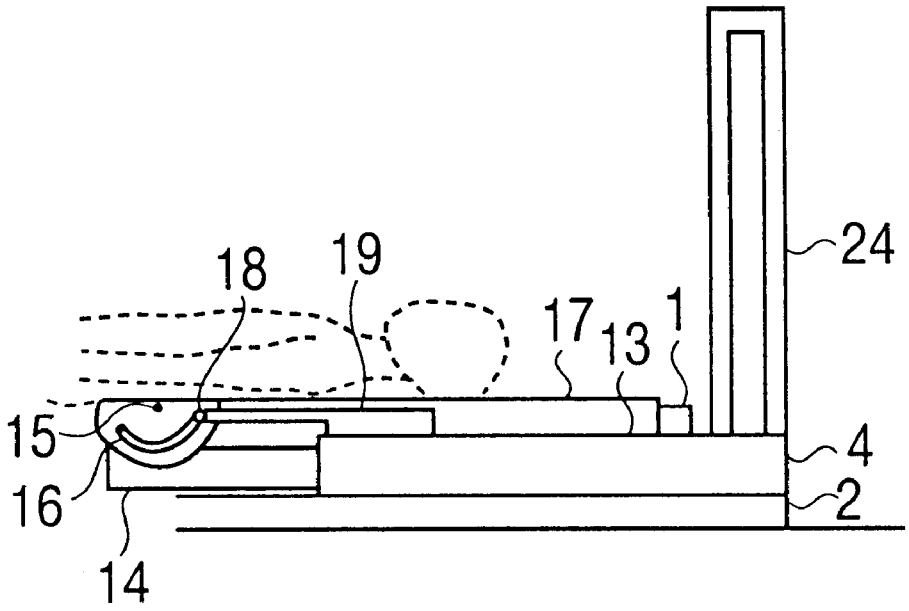
FIGS. 11(A) and 11(B) are side views, respectively, of the nursing bed of the present invention showing conditions in which a back-raised position of the patient's body is adjusted in the leg-side direction of the bed plate.
Figure 11B:
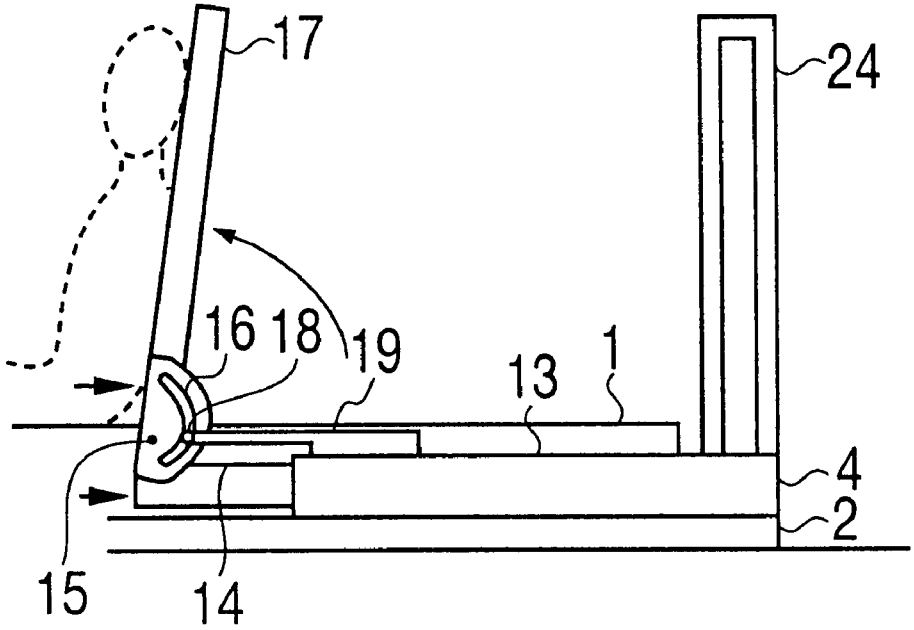
Figure 12A:
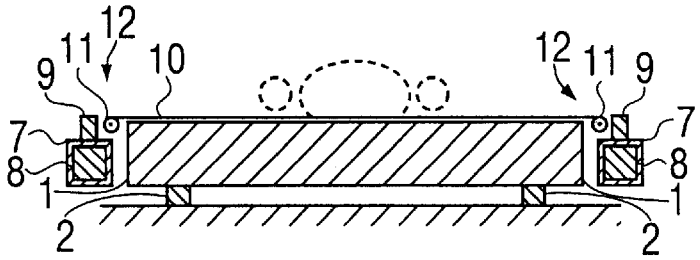
FIGS. 12(A) through 12(D) are head-side end views of the nursing bed of the present invention illustrating conditions of the waist portion of the patient when the patient is turned.
Figure 12B:
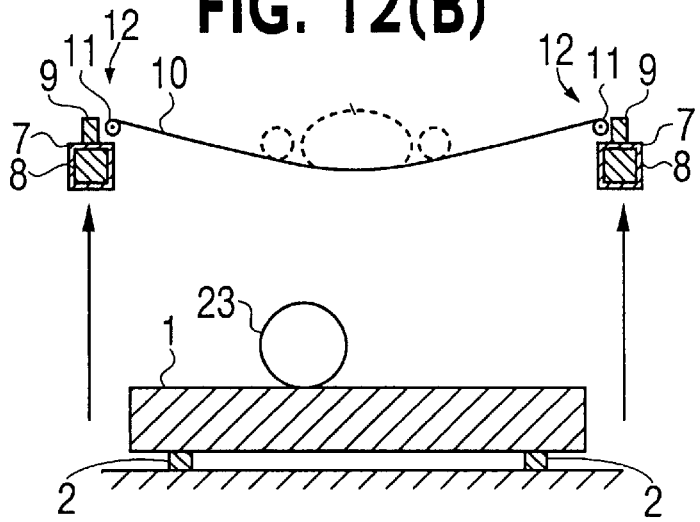
Figure 12C:
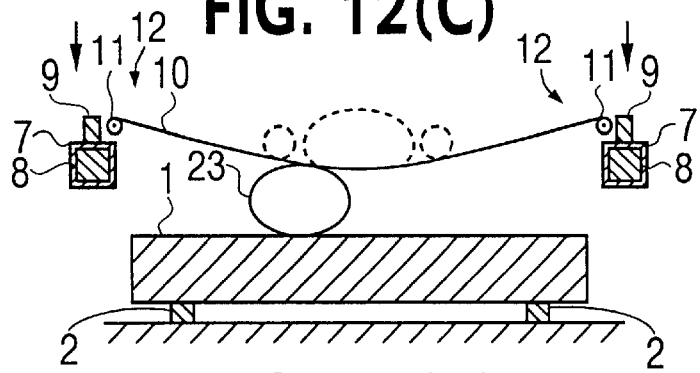
Figure 12D:
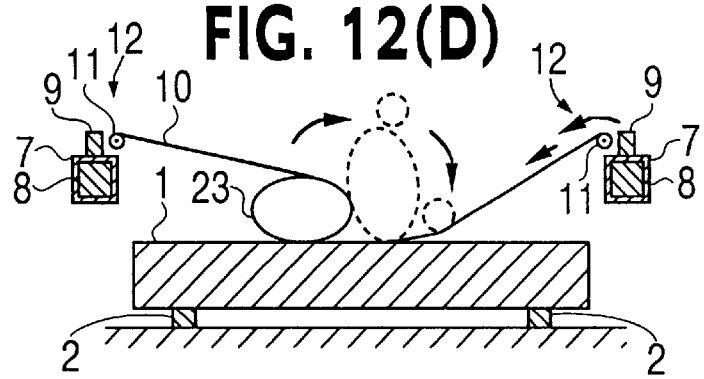
Figure 13:
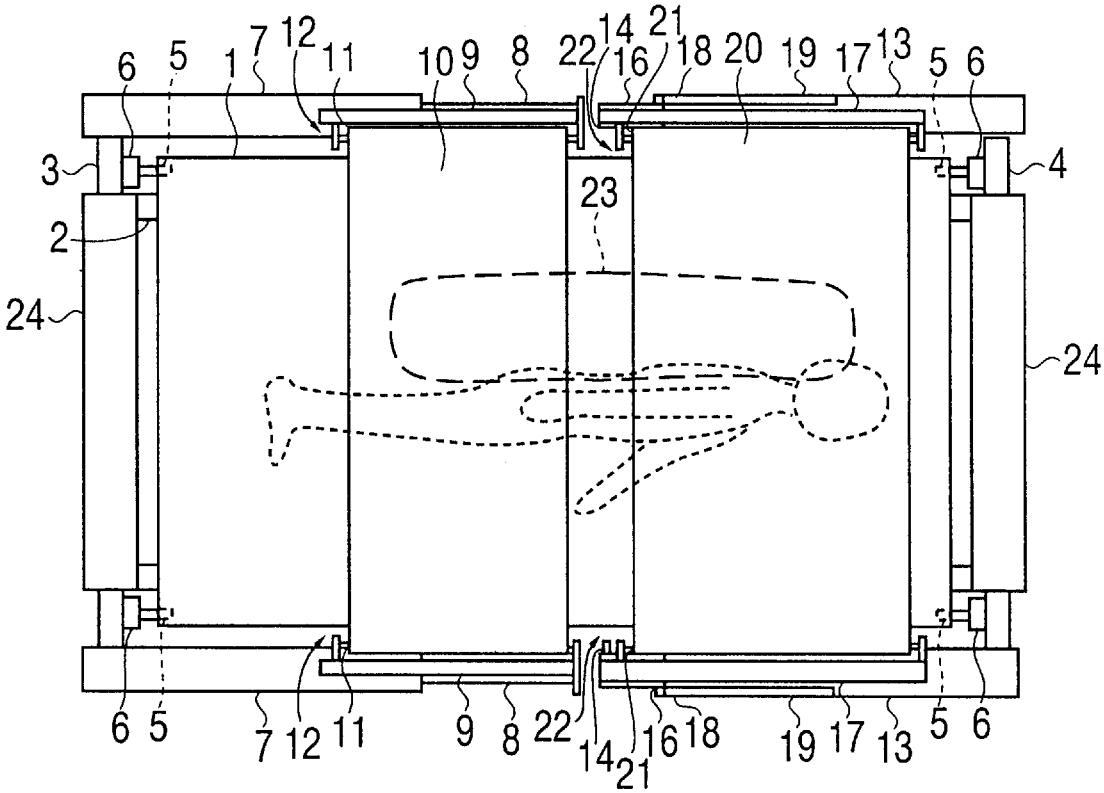
FIG. 13 is a plan view of the nursing bed of the present invention showing a condition in which the patient has been turned.

FIGS. 12(A) through 12(D) illustrate how to change the posture of a patient. It should be noted that throughout the drawings, the body of a patient is shown by a broken line, and in FIGS. 12(A) through 12(D) what is shown by broken lines is a section taken along the waist portion of the patient lying on his back. Further, in the instant embodiment, how the posture of a patient lying on his back on the bed plate changes when he has turned over to the right is described, but the invention is not limited thereto, and the invention is applicable to every possible posture change. Where it is desired to cause the patient to turn over to the right, the leg-side rails 8 are first slid to adjust the distance between the leg-side net 10 and the head-side net 20 to cause both of the nets to become stretched fully to the right and left (refer to FIG. 12(A)) and then the body of the patient is raised above the bed plate 1 in a hammock fashion by using the leg-side lifts 3 and the head-side lifts 4 (refer to FIGS. 7, 8 and 12(B)). Next, an elongate pillow-like cushion 23 is set lengthwise on the bed plate 1 (refer to FIG. 12(B)) and then the body of the patient is lowered until it comes into contact with the cushion 23 (refer to FIG. 12(C)). After that, only the leg-side net winding drum 11 and the head-side net winding drum 21 on the right, toward which the patient turns over, are rotated inward to loosen the right leg-side net 10 and the head-side net 20, thereby causing the body of the patient to face sideways and to the right (refer to FIG. 12(D) and FIG. 13). Lastly, the elongate pillow-like cushion 23 is removed from the bed plate 1 as a final step. It should be noted that in the instant embodiment, although an air-cushion is used to serve as the elongate pillow-like cushion 23, any other kind of cushion, such as a folded futon, may be used, and there is no limitation on the size of such cushion if the cushion can be utilized for changing the posture of a patient.

As described above, the nursing bed according to the present invention produces the following effects.

The adjustment of the height of the bed plate is made possible by connecting the leg-side lifts and the head-side lifts to the bed plate by means of the four connecting devices and simultaneously moving the leg-side end and the head-side end of the bed plate vertically.

The upper portion of the back of the body of a patient is raised upward while the headside net is slid toward the head-side end of the bed plate because the larger the angle of each of the head-side mounting arms with respect to each of the head-side rails, the shorter the distance between the position of each of the cam grooves respectively fixed by the cam rollers and each of the shafts respectively fixed to the head-side rails, allowing the head-side rails to automatically slide toward the head-side end of the bed plate in correspondence to the degree of shortening of the distance, so that the body of the patient is never pushed forward at the time of raising the back of the body of the patient. On the contrary, the smaller the angle of each of the head-side mounting arms with respect to each of the head-side rails, the longer the distance between the position of each of the cam grooves respectively fixed to the head-side rails and each of the shafts respectively fixed to the head-side rails, allowing the head-side rails to automatically slide toward the leg-side end of the bed plate in correspondence to the degree of enlargement of the distance, so that the back of the body of the patient is lowered while the head-side net is slid toward the leg-side end of the bed plate and the patient's body is never separated from the head-side net at the time of lowering the back of the patient's body.

In order to lift up the patient's body above the bed plate in a hammock fashion, the leg-side lifts, and the head-side lifts disconnected from the bed plate, are manipulated so that the lower portion of the patient's body can be supported by the leg-side net and the upper portion of the patient's body can be raised by the head-side net. Further, it is also possible to adjust the height of the leg-side net and that of the head-side net separately from each other in a hammock fashion.

The distance between the leg-side net and the head-side net can be adjusted by the movement of the leg-side net, which slides in interlocking relationship with the leg-side rails. By reducing the distance, the patient's waist can be securely supported by the leg-side net while by enlarging the distance, the space around the patient's waist is made free, thereby facilitating various kinds of nursing operations.

In order for the patient to sit down on a chair or on a closet on the bed plate, the leg-side net and the head-side net are held fully stretched by adjusting the distance between the two nets, the bed plate is placed on the base, the connecting devices are disconnected, the patient's body is supported in a hammock fashion above the bed plate, the chair or closet is set up on the bed plate, the leg-side net and the head-side net are lowered until the patient's waist is placed on the chair or closet, where the leg-side net reaches the chair or closet, the leg-side net is slid to enlarge the distance to the head-side net, the back of the patient's body is raised and the leg-side net is lowered down to the surface of the bed plate, thereby causing the patient to assume a sitting posture. Further, when the above-described steps are reversed, it is possible for the bed plate to return to its normal condition.

Further, in order to freely adjust the condition of the leg-side net or the head-side net when supporting the patient in a hammock fashion or raising the back of the patient's body, the leg-side winding drums or the head-side winding drums may be rotated outward for stretching or may be rotated inward for loosening.

As regards the forward and rearward positions of the back of the patient's body, the position at which the back of the upper portion of the patient's body is raised can be adjusted forward and rearward by changing the position at which the right and left cam rollers are fixed to the head-side arms forward or rearward.

To change the posture of the patient to the right or left, the distance between the leg-side net and the head-side net is adjusted to stretch both of the nets fully to the right and left. The patient's body is lifted above the bed in a hammock fashion, the elongate pillow-like cushion is set lengthwise on the bed plate, and the patient's body is lowered until it reaches the elongate pillow-like cushion. Only the leg-side net winding drum and the head-side net winding drum on the side toward which the patient is desired to turn toward are then rotated inward to loosen the leg-side net and the head-side net, thereby turning the patient's body sideways.

Even when the back of the patient is raised, the patient's clothes are changed, a chair or closet is used or turning of the patient is desired, the sheet and the like are never disordered since the leg-side net and the head-side net cover the surface of the bed plate or support the patient in a hammock fashion.

What is claimed is:

1. A posture changing method of a nursing bed, comprising:

separating a bed plate that is on a base of a nursing bed from leg-side lifts and head-side lifts of the nursing bed;

fully stretching a leg-side net and a head-side net of the nursing bed;

supporting the body of a patient on the leg-side net and the head-side net above the bed plate using the leg-side lifts and the head-side lifts while the patient faces upwards;

placing an elongate cushion lengthwise on the bed plate;

lowering the body of the patient until the body comes into contact with the elongate cushion;

rotating a leg-side net winding drum and a head-side winding drum respectively connected with the leg-side and head-side nets on one of the left and right sides toward which it is desired to turn the patient so as to loosen the leg-side net and the head-side net, so that the body of the patient rolls on the elongate cushion toward the one of the left and right sides, and so that the body of the patient reaches is supported by the bed plate; and removing the elongate cushion from the bed plate.

2. A posture changing method of a nursing bed which comprises:

a bed plate provided with connecting sections arranged on both sides of a leg-side portion and on both sides of a head-side portion thereof, a rectangular base capable of allowing the bed plate to be placed on a central portion thereof, with the length of the base being larger than that of the bed plate (1), a pair of leg-side lifts respectively arranged on both sides of a leg-side end of the base capable of being adjusted in height, a pair of head-side lifts 4 respectively arranged on both sides of a head-side end of the base capable of being adjusted in height, four connectors arranged at portions of the leg-side lifts and the head-side lifts, respectively, and capable of being connected to and separated from, the connecting sections of the bed plate at the lowermost positions of the leg-side and head-side lifts such that when the connectors are connected to the connecting sections of the bed plate, the bed plate is located on the base, a pair of hollow leg-side arms having inner surfaces serving rail guides, extending parallel and horizontally toward the head-side portion of the bed plate up to a position substantially one third of the length of the bed plate, having therebetween a space larger than the width of the bed plate, and being capable of moving vertically in interlocking relationship with the leg-side lifts, a pair of leg-side rails respectively retained within the pair of leg-side arms and capable of sliding toward the head-side portion of the bed plate in interlocking relationship with each other, a pair of leg-side fixing arms extending parallel to the outer sides of the leg-side arms above the head-side top ends of the leg-side rails and toward the leg-side portion of the bed plate and being capable of sliding in interlocking relationship with the leg-side rails, a pair of leg-side net winders attached to the pair of leg-side fixing arms, respectively, and provided with a pair of leg-side net winding drums capable of being operated independently of each other, a leg-side sheet net having a width larger than the distance between the pair of leg-side net winding drums and having both sides thereof removably fixed to the leg-side net winding drums, respectively, so that when the leg-side winding drums are rotated outward, the leg-side net is stretched, while when the winding drums are rotated inward, the leg-side net is loosened, wherein an intermediate portion of the net can be arranged between the bed plate and a lower portion of the body of a patient so as cover the upper surface of the bed plate and so as to lift the lower portion of the patient, a pair of hollow head-side arms having inner surfaces serving as rail guides extending parallel and horizontally toward the leg-side portion of the bed plate up to a position substantially one-third of the length of the bed plate, leaving therebetween a space larger than the width of the bed plate, and being capable of moving vertically in interlocking relationship with each other, a pair of head-side rails respectively retained within the pair of head-side arms capable of sliding therein in interlocking relationship with each other, a pair of head-side fixing arms each having one end thereof rotatably supported by a shaft at leg-side portions of a pair of head-side rails and provided at a portion thereof below the shaft with a circular arc-shaped cam groove which extends further from the shaft toward the head-side end of the bed plate than toward the leg-side end of the bed plate so that the head-side fixing arms can rotate about the shaft upward in interlocking relationship with each other to an angle of substantially 90° from horizontal positions parallel to the head-side arms, a pair of cam roller fixing bars having head-side portions fixed to the head-side arms, respectively, and leg-side portions respectively provided with cam rollers in respective ones of the cam grooves such that the larger the angle between the head-side rails and the head-side fixing arms, the shorter the distance between the cam rollers and the shaft due to rotation of the cam grooves thereby causing the head-side rails to automatically slide toward the head-side end of the bed plate by the distance, a pair of head-side net winders respectively attached to the pair of head-side fixing arms and provided with a pair of head-side net winding drums (21) capable of being operated independently of each other, and a head-side net sheet having a width larger than the distance between the pair of head-side net winding drums and having both sides thereof removably fixed to the head-side net winding drums, respectively, so that when the head-side net winding drums are rotated outward, the head-side net is stretched, while when the winding drums are rotated inward, the head-side net is loosened, wherein the intermediate portion of the net can be arranged between the bed plate and the upper portion of the body of a patient so as to cover the upper surface of the bed plate and so as to lift the upper portion of the patient or to raise the back of that portion of the body of the patient;

said posture changing method comprising:

separating the bed plate from the leg-side lifts and the head-side lifts;

fully stretching the leg-side net and the head-side net;

supporting the body of a patient on the leg-side net and the head-side net above the bed plate using the leg-side lifts and the head-side lifts while the patient faces upwards;

placing an elongate cushion lengthwise on the bed plate;

lowering the body of the patient until the body comes into contact with the elongate cushion;

rotating one of the leg-side net winding drums and one of the head-side winding drums respectively connected with the leg-side and head-side nets on one of the left and right sides toward which it is desired to turn the patient so as to loosen the leg-side net and the head-side net, so that the body of the patient rolls on the elongate cushion toward the one of the left and right sides, and so that the body of the patient reaches is supported by the bed plate; and removing the elongate cushion from the bed plate.

3. The method of claim 2 wherein the positions at which the head-side portions of the pair of cam roller fixing bars are respectively fixed to the pair of head-side arms can be adjusted forward and rearward, whereby the position at which the back of the upper position of the patient's body is raised by the head-side net is made adjustable forward and rearward.

* * * * *